US009815669B2

(12) United States Patent
Magni

(10) Patent No.: US 9,815,669 B2
(45) Date of Patent: Nov. 14, 2017

(54) TELESCOPIC ARM FOR OPERATING MACHINES

(71) Applicant: C.M.C. S.R.L.—SOCIETÁ UNIPERSONALE, Modena (IT)

(72) Inventor: Riccardo Magni, Modena (IT)

(73) Assignee: C.M.C. S.R.L.—SOCIETA UNIPERSONALE, Modena (IT)

( * ) Notice: Subject to any disclaimer, the term of this patent is extended or adjusted under 35 U.S.C. 154(b) by 32 days.

(21) Appl. No.: 14/412,919

(22) PCT Filed: Jul. 2, 2013

(86) PCT No.: PCT/IB2013/001409

§ 371 (c)(1),
(2) Date: Jan. 5, 2015

(87) PCT Pub. No.: WO2014/006474

PCT Pub. Date: Jan. 9, 2014

(65) Prior Publication Data

US 2015/0151954 A1 Jun. 4, 2015

(30) Foreign Application Priority Data

Jul. 6, 2012 (IT) ..... MO2012A0170

(51) Int. Cl.
*B66C 23/70* (2006.01)
*B66C 13/14* (2006.01)

(52) U.S. Cl.
CPC ..... *B66C 23/703* (2013.01); *B66C 13/14* (2013.01); *B66C 23/701* (2013.01)

(58) Field of Classification Search
CPC ..... B66C 23/70; B66C 23/701; B66C 23/703; B66C 23/705; B66C 23/706; B66C 23/04; B66C 23/64; B66C 23/62; B66C 13/12; B66C 13/14; E02F 3/286; E02F 3/304; E02F 3/305; E02F 3/306; E02F 3/3402; E02F 3/4136; B66F 11/046; B66F 9/0655
(Continued)

(56) References Cited

U.S. PATENT DOCUMENTS 2,571,858 A * 10/1951 Garland ..... B66C 23/36 212/231
4,034,875 A * 7/1977 Pugh ..... B66F 9/0655 137/355.17
2003/0205547 A1 11/2003 Dupre et al.

FOREIGN PATENT DOCUMENTS

DE 3447095 A1 * 7/1986 ..... B66C 23/701

OTHER PUBLICATIONS

International Search Report of PCT/IB2013/001409 dated Oct. 24, 2013.

* cited by examiner

*Primary Examiner* — Sang Kim
*Assistant Examiner* — Juan Campos, Jr.
(74) *Attorney, Agent, or Firm* — Arent Fox LLP

(57) ABSTRACT

The telescopic arm for operating machines includes an outer arm, four coaxial slip-off elements, first, second, third, fourth and an operative head associated to the latter. The telescopic arm includes: a drive system, supported partially outside of the telescopic arm, for moving synchronously said slip-off members in their extending and returning travels; a hydraulic circuit, housed inside said telescopic arm, comprising a first and a second group of hydraulic conduits, which include, respectively, first and second flexible pipes, kept stretched during the returning step of said slip-off members by the corresponding idler pulleys, supported by the latter.

10 Claims, 5 Drawing Sheets

(58) Field of Classification Search
USPC ..... 212/347–350; 137/355.17, 355.24;
239/165
See application file for complete search history.

TELESCOPIC ARM FOR OPERATING MACHINES

CROSS-REFERENCE TO RELATED APPLICATIONS

This application is a National Stage entry of International Application No. PCT/IB2013/001409, filed Jul. 2, 2013, which claims priority to Italian Patent Application No. MO2012A000170, filed Jul. 6, 2012. The disclosures of the prior applications are hereby incorporated in their entirety by reference.

DESCRIPTION OF THE INVENTION

The object of the invention is a telescopic arm aimed at fitting out self-propelled operating machines used in many fields, for example, building industry, agriculture or others.

The telescopic arm is usually articulated to a platform of the operating machine, with possibility to tilt in a vertical plane from a substantially horizontal position to a nearly vertical one, by means of suitable hydraulic jacks.

The telescopic arm is formed by a tubular outer arm and one or more coaxial slip-off elements, which have decreasing tubular section, are coupled telescopically and whose outgoing and ingoing movements need one or more hydraulic jacks.

In order to avoid the increase of the number of jacks or the use of multistage jacks, when there are more slip-off members, a chain transfer system is used linking the first slip-off member (operated directly by the jack) to the subsequent ones, so that its outgoing or ingoing stroke is transmitted at the same time and in the same extent also to the other slip-off elements.

The last of said slip-off elements has, associated thereto, an operative head, aimed at supporting, by suitable connection means, the tools aimed at performing specific operations, for example, forks, hooks or the like, in order to move the loads from the ground to the height, or vice versa, or aerial work platforms to move one or more workers to a working area situated over the ground.

The operative head must have enough degrees of freedom with respect to the arm, so as to place the tool or the aerial work platform in the correct working position, whatever tilting angle the telescopic arm has assumed.

The tool, in turn, can be provided with moving elements and actuators which control such movements; for these reasons, the telescopic arm must be associated with a bundle of hydraulic pipes, capable of supplying, as well as allowing the return of the fluid under pressure to and from the operative head, following the change of the length of the same arm as a result of the extension and return of various slip-off elements. Therefore, the hydraulic pipes mentioned above, must be of flexible type, for at least a part of their length. In order to prevent the flexible pipes from assuming uncontrolled positions, which imply the risk of twisting, in particular during the returning step of the slip-off elements, various constructive tricks are known, for example, the introduction of the flexible pipes into articulated pipe holding channels, of the same type as those used for electric cables.

The Industrial Patent Application N. MO2011A000333 filed on 23 Dec. 2011 by the Applicant, protects a "*Method and apparatus for keeping flexible pipes or conduits situated side by side in an orderly way*", in which the latter are placed side by side and parallel and become integral by means of gluing, heat welding or with help of joining elements arranged at prefixed distance intervals. Consequently, the bundle of pipes obtained according to said method can be bent by 180° or more, and allows such a curve to move dynamically during the outgoing and ingoing movements of the slip-off member, without reciprocal movements among the single pipes.

Another known solution includes a pulley, associated to its slip-off member, aimed at engaging the flexible pipes along the part, in which they are bent by 180°, keeping them stretched during the returning step.

The just mentioned solutions, concerning the above mentioned hydraulic circuit, are applied only to arms having at most three slip-off elements. Consequently, it is obvious that a considerable number of components are required, which must be placed correctly, so as not to interfere with the respective functions, to provide a telescopic arm with a system for moving the slip-off elements and a hydraulic circuit for supplying the tools situated at its end; obviously, the number of components and the respective location problems increase together with the increasing number of slip-off elements. In particular, the constructive solutions used so far for telescopic arms with four slip-off elements are not optimal, because:

- in some cases, the bundle of hydraulic pipes, aimed at supplying the operative head and/or tool, is placed outside of the arm, which results in a considerable space occupied beyond the arm section, and a risk of breaking in case of impact with outer obstacles and unacceptable aesthetic aspect;
- in other cases, the slip-off elements are operated by multistage jacks or separate jacks, with the drawbacks deriving from the bigger constructive complexity, increase of the number of hydraulic pipes to place, complication of the control logic and more frequent maintenance, which cause a considerable increase of costs.

Therefore, it is an object of the present invention to propose a telescopic arm for operating machines, in particular of the type with four slip-off elements, capable of overcoming the reported drawbacks of the prior art, related to the drive system of outgoing and ingoing movements of the latter, as well as the hydraulic circuit aimed at supplying the operative head and/or tool.

Another object of the invention is to obtain a telescopic arm, in which the above mentioned hydraulic circuit for supplying the operative head and/or tool is housed inside the slip-off elements, both for greater protection against unintentional pipe breaking and for better aesthetic neatness of the arm.

A further object of the invention is to obtain a telescopic arm, in which the operation logic of the slip-off elements drive system is compatible with the requirement of the configuration of the above mentioned hydraulic circuit, and is as simple and compact as possible.

The above mentioned objects are wholly obtained by a telescopic arm for operating machines, of the type including a tubular outer arm, hinge-articulated to a platform provided in said machine, four coaxial slip-off members having a tubular decreasing section, respectively, first, second, third and fourth member, from the biggest to the smallest one, and an operative head associated at the free end of said fourth slip-off member, with said telescopic arm being tiltable in a vertical plane, from a substantially horizontal position to a nearly vertical one and aimed at assuming a close configuration, in which said slip-off members are introduced one into another and housed in said outer arm, and an open configuration, in which the same slip-off members are at least partially extended to place the above mentioned operative head in a prefixed working area, with the same telescopic arm including:

a system supported, at least partially, outside of the above mentioned telescopic arm, for moving synchronously and with unitary mutual relationship, said slip-off members in their outgoing and ingoing strokes;

a hydraulic circuit, housed inside said telescopic arm, connected to an outer hydraulic system, for supplying and returning fluid under pressure to and from said operative head, with the above mentioned hydraulic circuit comprising: a first group of hydraulic conduits, in which first flexible pipes are provided, set in communication with said hydraulic system, with the ends fastened, upstream and downstream respectively, to said outer arm and to the inner head of said second slip-off member; a first idler pulley, supported at the inner head of said first slip-off member, in dynamic engagement with said first flexible pipes and aimed at keeping the latter stretched during the ingoing step of the same first and second slip-off members; first rigid pipes, connected in series to said first flexible pipes and extended along said second slip-off member up to its outer head; a second group of hydraulic conduits, connected in series to the first one, the second group including second flexible pipes set in communication with said first rigid pipes and fastened, with the respective ends, upstream and downstream, to said second slip-off member and to the inner head of said fourth slip-off member; a second idler pulley, supported at the inner head of said third slip-off member, in dynamic engagement with said second flexible pipes and aimed at keeping the latter stretched during the returning step of the same third and fourth slip-off members; second rigid pipes, connected in series to said second flexible pipes and extended along said fourth slip-off member up to said operative head.

The characteristics of the invention will become obvious from the following description of a preferred embodiment of the telescopic arm under discussion, in accordance with the contents of claims and with help of the enclosed drawings, in which:

Figure 1:
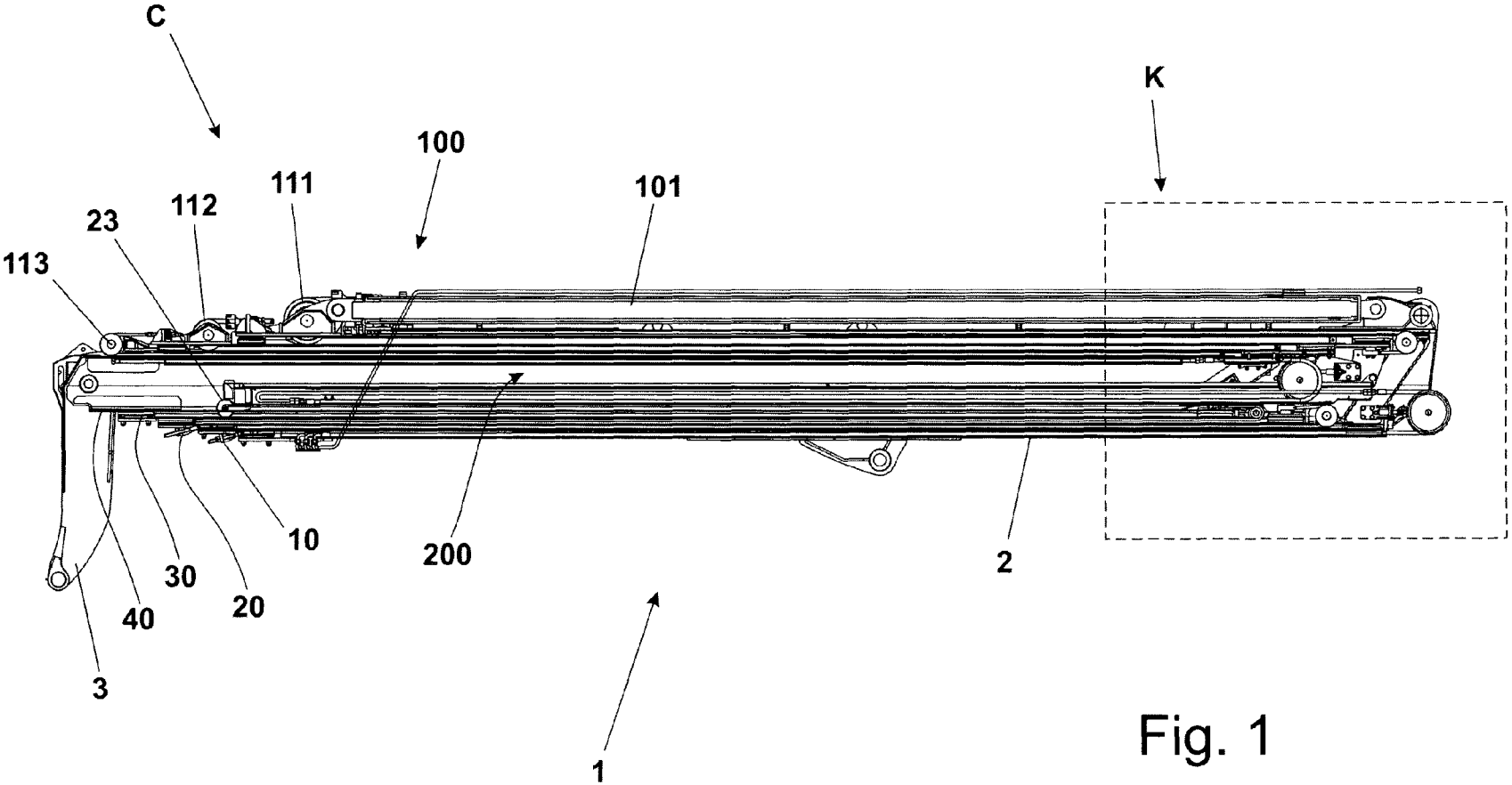
FIG. 1 illustrates a section side view of the telescopic arm under discussion, with the slip-off elements retracted.

With reference to the above mentioned figures, the reference numeral 1 indicates the telescopic arm under discussion, as a whole.

The telescopic arm 1 is aimed at fitting out known self-propelled operating machines (not shown), for example, used in building industry, agriculture, earthmoving or others.

Normally, the telescopic arm 1 is articulated to a platform of the operating machine, with possibility to tilt in a vertical plane from a substantially horizontal position to a nearly vertical one.

The telescopic arm 1 is formed, in a way known in itself, by a tubular outer arm 2 and four coaxial slip-off elements having decreasing tubular section, coupled in a telescopic way, from the biggest to the smaller one, respectively, first 10, second 20, third 30 and fourth 40.

An operative head 3, associated to the free end of said fourth slip-off member 40, is aimed at supporting, by means of suitable connection means, tools aimed at performing specific operations; said connection means and tools, of known type, have not been shown, since not directly relevant to the invention. The telescopic arm 1, in accordance with the invention, is provided with a system 100 for moving synchronously and with the same extent said slip-off elements 10, 20, 30, 40 in their outgoing and ingoning strokes.

In a close configuration C of the telescopic arm 1 (FIGS. 1, 2, 5C, 6B), the slip-off elements 10, 20, 30, 40 are introduced one into another, and housed in said outer arm 2, while in an open configuration A of the same telescopic arm 1 (FIGS. 4, 5A, 5B, 6A), they are at least partially extended to place the above mentioned operative head 3 in a prefixed working area, with a suitable combination with a prefixed inclination of the above mentioned telescopic arm 1.

The system 100, supported in part outside of the telescopic arm 1 and in part inside it, includes:

a linear actuator 101, supported outside of said outer arm 2 with its axis parallel thereto, with the respective movable stem 102 connected to said first slip-off member 10 and aimed at moving the same to go out and to go into said outer arm 2;

first rope driving means 110, operated as a consequence of said first slip-off member 10 going out, connected to the remaining second 20, third 30 and fourth 40 slip-off members and aimed at making the latter carry on their corresponding outgoing strokes, synchronous and proportional to the one of the same first slip-off member 10;

second rope driving means 120, operated as a consequence of said first slip-off member 10 ingoing stroke and connected to the remaining second 20, third 30 and fourth 40 slip-off members and aimed at making the latter carry on their respective ingoing strokes, synchronous and proportional to the one of the same first slip-off member 10.

The above mentioned first rope driving means 110, according to the preferred embodiment, include in turn:

a first pulley 111, supported idle outside of said first slip-off member 10, at the respective outer head 10*e*, with its horizontal axis perpendicular to the longitudinal axis X of the telescopic arm 1;

a first inextensible rope or chain C1, having a prefixed length and the ends fastened respectively to the outer arm 2 and the inner head 20*i* of the second slip-off member 20, stretched by said first pulley 111 to define an upper branch Rs1 and a lower branch Ri1 parallel to said longitudinal axis X of the telescopic arm 1; with the extent of said upper branch Rs1 aimed at increasing due to the slipping off of the first slip-off element 10, which causes a proportional reduction of the extent of the remaining lower branch Ri1 and an outgoing stroke of the associated second slip-off member 20, equal to the sum of the variations of the extent;

a second pulley 112, supported idle outside of said second slip-off member 20, at the respective outer head 20*e*, with its horizontal axis perpendicular to the longitudinal axis X of the telescopic arm 1;

a second inextensible rope or chain C2, having a prefixed length and the ends fastened respectively to the first slip-off member 10 and the inner head 30*i* of the third slip-off member 30, stretched by said second pulley 112 to define an upper branch Rs2 and a lower branch Ri2 parallel to said longitudinal axis X of the telescopic arm 1, with the extent of said upper branch Rs2 aimed at increasing due to the slipping off of the second slip-off element 20, which causes a proportional reduction of the extent of the remaining lower branch Ri2 and an outgoing stroke of the associated third slip-off member 30, equal to the sum of the variations of the extent;

a third pulley 113, supported idle outside of said third slip-off member 30, at the respective outer head 30*e*, with its horizontal axis perpendicular to the longitudinal axis X of the telescopic arm 1;

a third inextensible rope or chain C3, having a prefixed length and the ends fastened respectively to the second slip-off member 20 and the inner head 40*i* of the fourth slip-off member 40, stretched by said third pulley 113 to define an upper branch Rs3 and a lower branch Ri3 parallel to said longitudinal axis X of the telescopic arm 1, with the extent of said upper branch Rs3 aimed at increasing due to the slipping off of the third slip-off element 30, which causes a proportional reduction of the extent of the remaining lower branch Ri3 and an outgoing stroke of the associated fourth slip-off member 40, equal to the sum of the variations of the extent.

The above mentioned second rope driving means 120, in the shown example, include in turn:

a fourth pulley 124, supported idle inside of said first slip-off member 10, at the respective inner head 10*i*, with its horizontal axis perpendicular to the longitudinal axis X of the telescopic arm 1;

a fourth inextensible rope or chain C4 having a prefixed length and the ends fastened respectively to the outer arm 2 and the inner head 20*i* of the second slip-off member 20, stretched by said fourth pulley 124 to define an upper branch Rs4 and a lower branch Ri4 parallel to said longitudinal axis X of the telescopic arm 1, with the extent of said upper branch Rs4 aimed at increasing due to the slipping off of the first slip-off element 10, which causes a proportional reduction of the extent of the remaining lower branch Ri4 and an ingoing stroke of the associated second slip-off member 20, equal to the sum of the variations of the extent;

a fifth pulley 125, supported idle inside said second slip-off member 20, near the respective inner head 20*i*, with its horizontal axis perpendicular to the longitudinal axis X of the telescopic arm 1;

a fifth inextensible rope or chain C5, having a prefixed length and the ends fastened respectively to the first slip-off member 10 and the inner head 30*i* of the third slip-off member 30, stretched by said fifth pulley 125 to define an upper branch Rs5 and a lower branch Ri5 parallel to said longitudinal axis X of the telescopic arm 1, with the extent of said lower branch Ri5 aimed at increasing due to the ingoing movement of the second slip-off element 20, which causes a proportional reduction of the extent of the remaining upper branch Rs5 and an ingoing stroke of the associated third slip-off member 30, equal to the sum of the variations of the extent;

a sixth pulley 126, supported idle inside said third slip-off member 30, near the respective inner head 30*i*, with its horizontal axis perpendicular to the longitudinal axis X of the telescopic arm 1;

a sixth inextensible rope or chain C6, having a prefixed length and the ends fastened respectively to the third slip-off member 30 and the inner head 40*i* of the fourth slip-off member 40, stretched by said sixth pulley 126 to define an upper branch Rs6 and a lower branch Ri6 parallel to said longitudinal axis X of the telescopic arm 1, with the extent of said lower branch Ri6 aimed at increasing due to the ingoing movement of the third slip-off element 30, which causes a proportional reduction of the extent of the remaining upper branch Rs6 and an ingoing stroke of the associated fourth slip-off member 40, equal to the sum of the variations of the extent.

The telescopic arm 1 includes also a hydraulic circuit 200 housed therein, aimed at being connected to an outer hydraulic system 166, associated to the respective operating machine and comprising, in known way, high pressure pumps, selector valves and whatever is necessary to obtain fluid under pressure to be introduced into the hydraulic circuit 200 and supply, thereby, hydraulic actuators of the operative head 3 and/or the tool mounted thereon.

According to the prior art, the hydraulic circuit 200 is formed by feed pipes and return pipes, which allow to return the fluid from the operative head 3 toward said hydraulic system.

The hydraulic circuit 200 is suitably positioned inside the telescopic arm 1, so as not to interfere with the above mentioned second rope driving means 120, and includes:

a first group of hydraulic conduits 210, in which first flexible pipes 211 are provided, set in communication with said hydraulic system, with their ends fastened, respectively upstream and downstream, to said outer arm 2 and to the inner head 20*i* of said second slip-off member 20;

a first idler pulley 212, supported at the inner head 10*i* of said first slip-off member 10, in dynamic engagement with said first flexible pipes 211 and aimed at keeping the latter stretched during the ingoing step of the same first and second slip-off members 10, 20;

first rigid pipes 213, connected in series to said first flexible pipes 211 and extended along said second slip-off member 20 up to its outer head 20*e;* a second group of hydraulic conduits 220, connected in series to the first one, the second group including second flexible pipes 221 set in communication with said first rigid pipes 213 and fastened, with the respective ends, upstream and downstream, to said second slip-off member 20 and to the inner head 40*i* of said fourth slip-off member 40;

a second idler pulley 222, supported at the inner head 30*i* of said third slip-off member 30, in dynamic engagement with said second flexible pipes 221 and aimed at keeping the latter stretched during the ingoing step of the same third and fourth slip-off members 30, 40;

second rigid pipes 223, connected in series to said second flexible pipes 221 and extended along said fourth slip-off member 40 up to said operative head 3.

Figure 2:
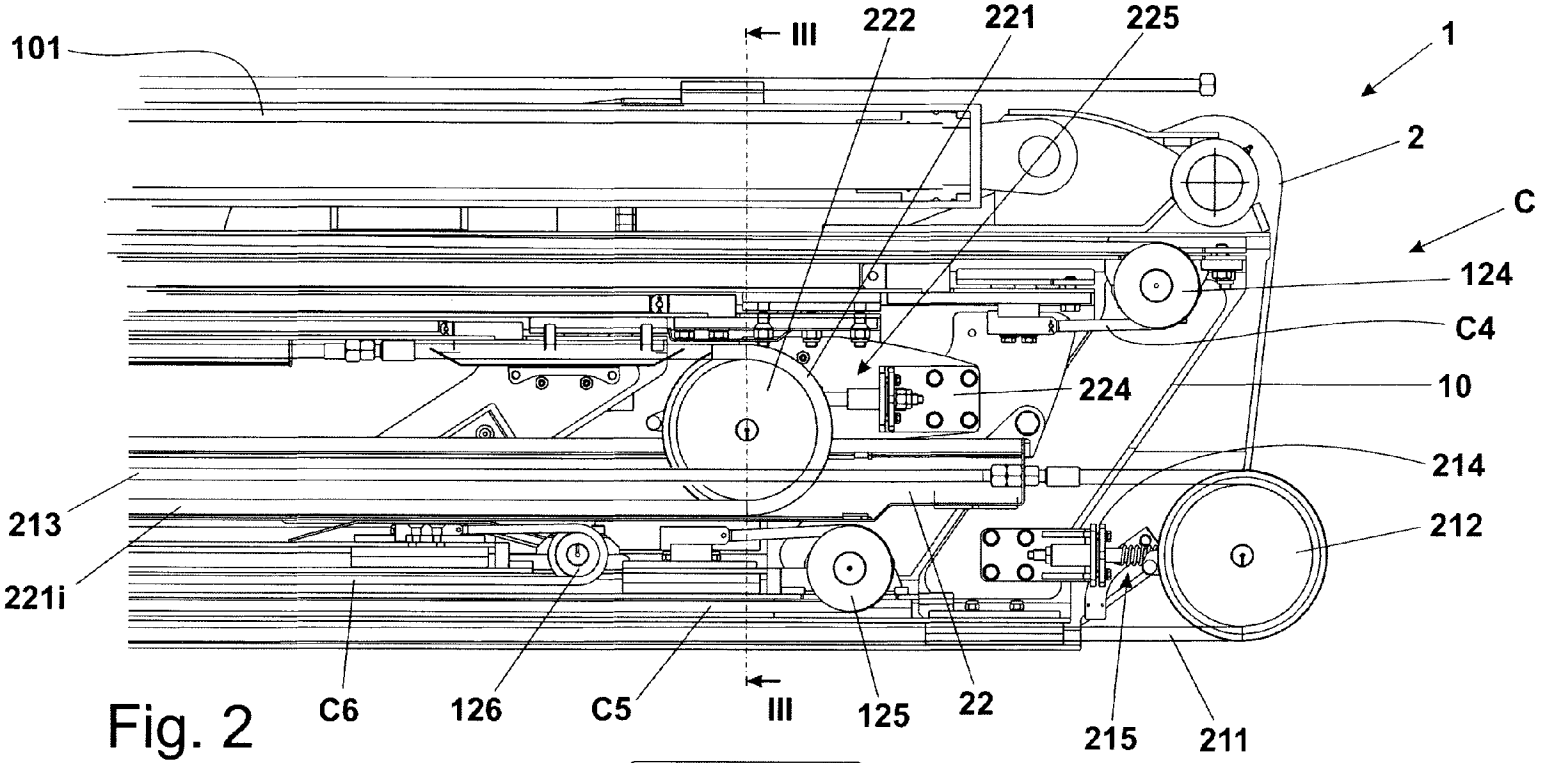
FIG. 2 illustrates the detail K of FIG. 1 in enlarged scale.

The first support 214, which binds the first pulley 212 to the first slip-off member 10 is advantageously provided with first spring tensioner 215, which allows the pulley 212 to make small resilient movements in a direction parallel to the longitudinal axis X of the telescopic arm 1, so as to avoid anomalous tensile stresses on the first flexible pipes 211 (FIG. 2).

Likewise, the second support 224, which binds the second pulley 222 to the third slip-off member 30 is provided with second spring tensioner 225 (see again FIG. 2).

Figure 3:
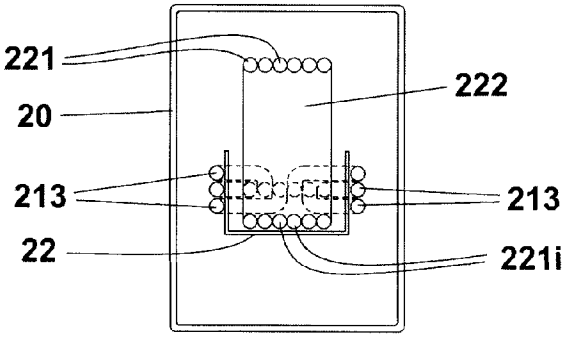
FIG. 3 illustrates a schematic section taken along the section plane III-III of FIG. 2, of some elements of the telescopic arm.

A "U"-profile channel-like holder 22 is fastened inside the second slip-off member 20, so as to hold and protect lower branches 221*i* of said second flexible pipes 221, delimited by their engagement with said second pulley 222 (FIG. 3).

The channel-like holder 22 avoids interferences between said lower branches 221*i* and the mentioned fifth chain C5, which is situated directly underlying (FIG. 2), and supports said first rigid pipes 213, which are suitably shaped in their initial part, directly downstream of the communicating first flexible pipes 211, so as to be disposed at the sides of the same channel-like holder 22 along its whole length (see in particular FIG. 3).

Figure 4:
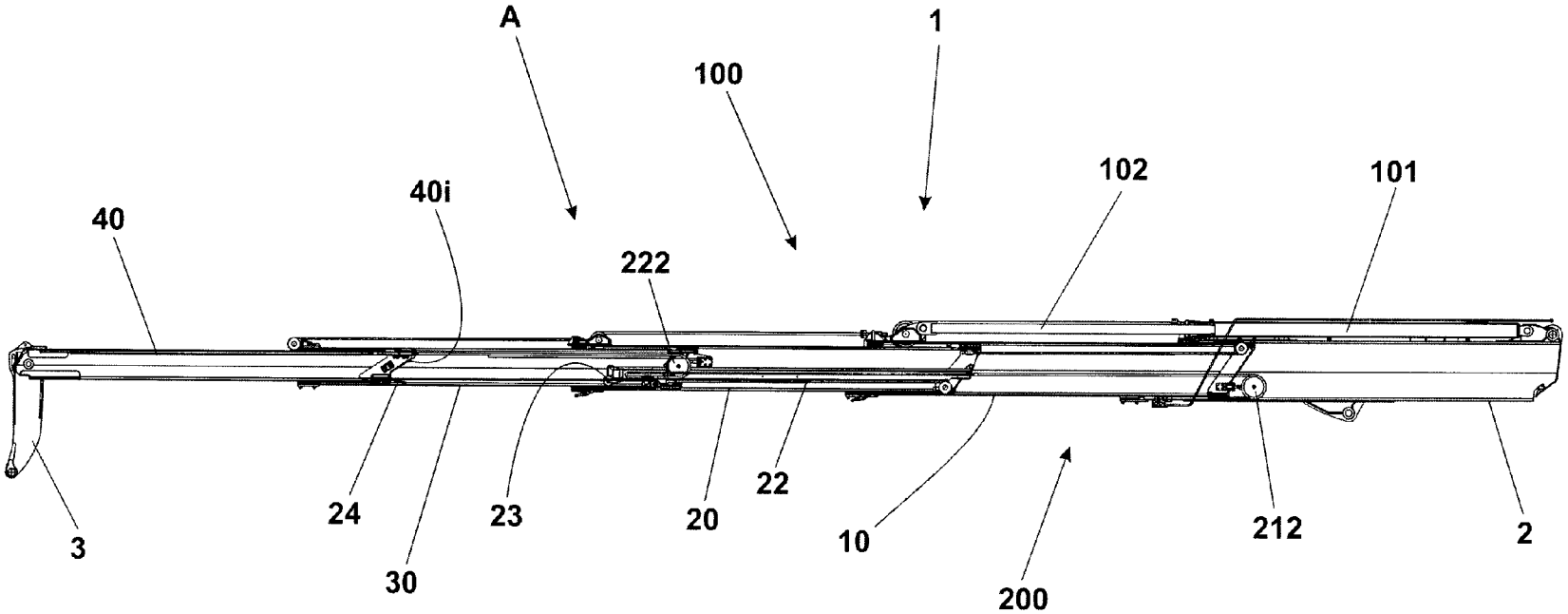
FIG. 4 illustrates a section side view of the telescopic arm of FIG. 1 with the slip-off elements extended.
Figure 5A:
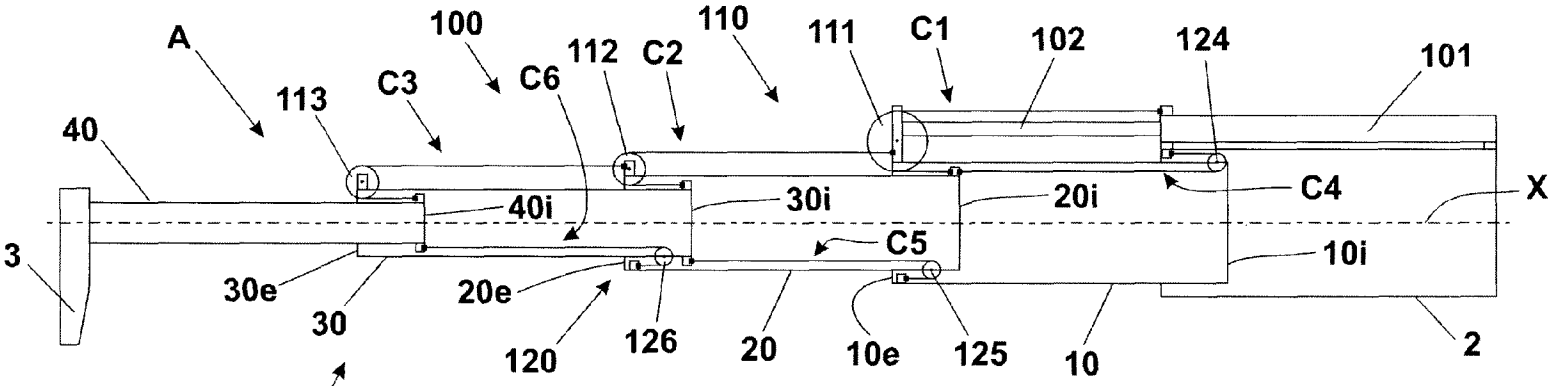
FIGS. 5A, 5B, 5C illustrate schematic lateral views of the telescopic arm and system for driving the slip-off elements, which are respectively extended, partially extended and retracted.
Figure 5B:
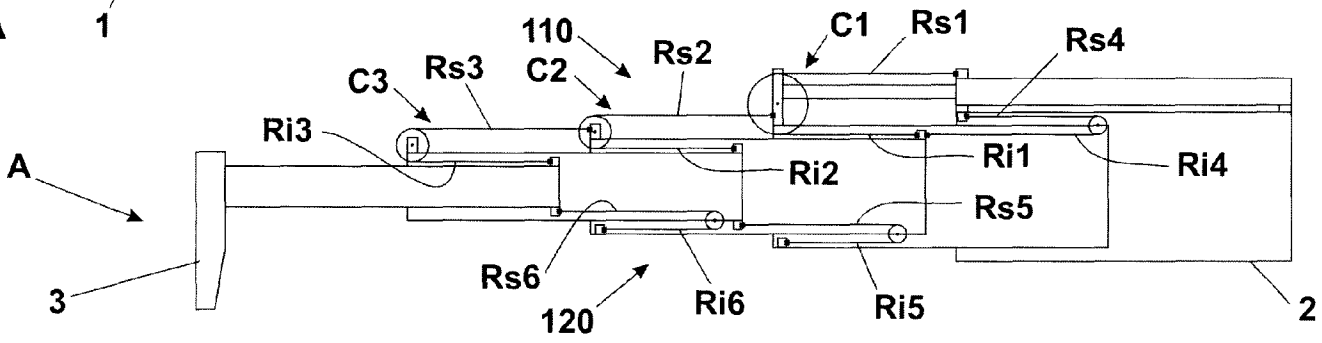
Figure 5C:
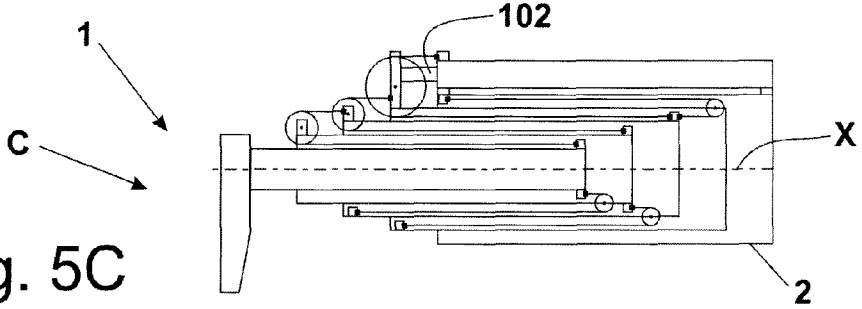
Figure 6A:
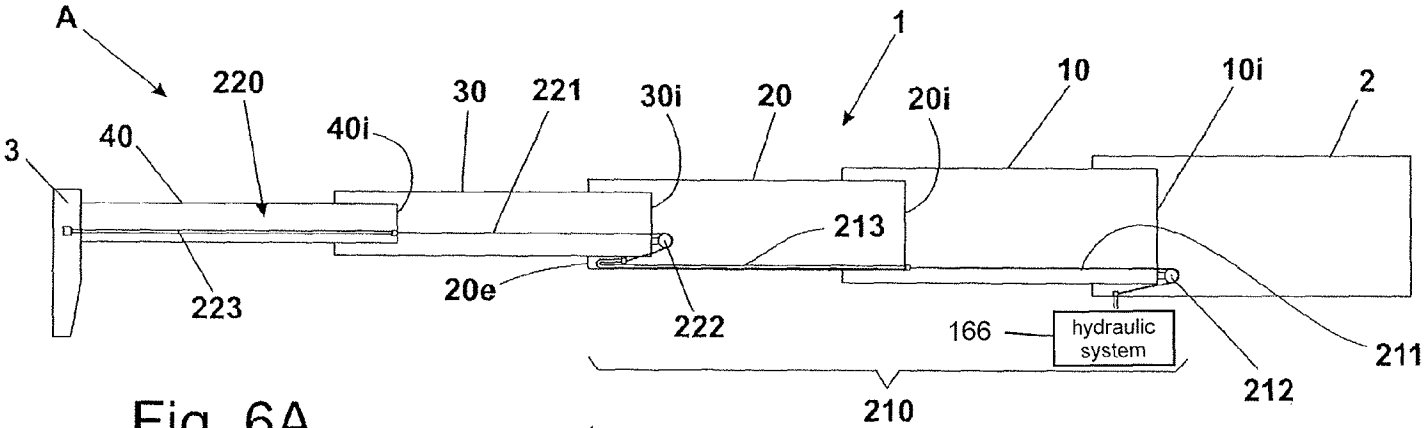
FIGS. 6A, 6B, illustrate schematic lateral views of the telescopic arm and hydraulic circuit inner to the slip-off elements, which are respectively extended, and retracted.
Figure 6B:
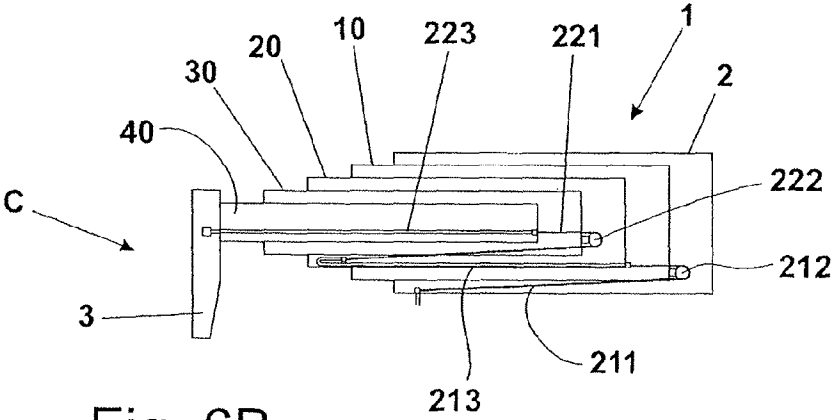

The channel-like holder 22 is supported only at its rear part, while the fore cantilevered end is provided with wheels 23 aimed at rolling on the lower horizontal walls of the tubular elements that form the third and fourth slip-off members 30, 40 (FIG. 1); a ramp 24, aimed at making up for the difference in level between said walls, is associated to the inner head 40*i* of said fourth slip-off member 40 (FIG. 4).

This prevents the channel-like holder 22 from downward bending and the subsequent third and fourth slip-off elements 30, 40 from being unintentionally hit during their return movement.

The channel-like holder 22 is functionally more advantageous with the maximum extent of said lower branch 221*i*, that is, when the telescopic arm 1 is in close configuration C (FIGS. 1, 2, 5C, 6B).

It appears obvious from the above description how the constructive and functional aspects of the system 100, for moving synchronously and with the same extent said slip-off elements 10, 20, 30, 40, are combined in best way with those of the hydraulic circuit 200, having the inner pipes kept stretched and in order, so as to obtain an original telescopic arm 1 with four slip-off elements, having peculiar characteristics, which make it advantageous with respect to the prior art solutions.

The configuration of the hydraulic circuit, with two groups of hydraulic conduits connected in series, each of which is provided with its own pulley for keeping stretched the respective flexible pipes, meets the functional requirements and allows a high protection against unintentional pipe breaking and better aesthetic neatness of the arm.

The channel-like holder provided in the second of the slip-off elements gives an important functional contribution to the "coexistence" of many members inside the slip-off elements, by preventing anomalous and potentially dangerous interference in the most packed area.

It is anyway understood that what above, has been described as a pure, non limiting example, therefore, possible constructive variations and/or changes of details remain within the same protective scope defined by the claims below.

The invention claimed is:

1. A telescopic arm including a tubular outer arm, first, second, third and fourth coaxial slip-off members having a decreasing tubular section, from the biggest to the smallest one, respectively, and an operative head associated at a free end of said fourth slip-off member, said telescopic arm configured to assume a closed configuration, in which said slip-off members are introduced one into another, and housed in said outer arm, and an open configuration, in which the four coaxial slip-off members are at least partially extended to place the operative head in a prefixed working area, the telescopic arm including:

a drive system, supported, at least partially, outside of the tubular outer arm, for synchronously moving the four slip-off members;

a hydraulic circuit, housed inside said tubular outer arm, connected to an outer hydraulic system, for supplying and returning fluid under pressure to and from said operative head, said hydraulic circuit comprising:

first pipes, set in communication with said outer hydraulic system, with ends of said first pipes fastened, respectively upstream and downstream, to said tubular outer arm and to an inner head of said second slip-off member;

a first idler pulley, supported at an inner head of said first slip-off member, in dynamic engagement with said first pipes and configured to keep the first pipes stretched during an ingoing stroke of the first and second slip-off members, wherein said first idler pulley is fastened to said first slip-off member by means of a first support provided with a first spring tensioner configured to allow the first idler pulley to make small resilient movements in a direction parallel to the longitudinal axis of the telescopic arm;

second pipes, connected in series to said first pipes and extended along said second slip-off member up to an outer head of the second slip-off member;

third pipes set in communication with said second pipes and fastened, with respective ends of said third pipes, upstream and downstream, to said second slip-off member and to an inner head of said fourth slip-off member;

a second idler pulley, supported at an inner head of said third slip-off member, in dynamic engagement with said third pipes and configured to keep the third pipes stretched during an ingoing stroke of the third and fourth slip-off members; and fourth pipes, connected in series to said third pipes and extended along said fourth slip-off member up to said operative head.

2. The telescopic arm as claimed in claim 1, wherein said drive system for synchronously moving said slip-off members includes:

a linear actuator, supported outside of said outer arm having an axis parallel thereto, with a movable stem connected to said first slip-off member and configured to move the first slip-off member for going out from and going into said outer arm;

first rope driving means for making the second, third, and fourth slip-off members carry on corresponding outgoing strokes, synchronous and proportional to the outgoing stroke of the first slip-off member;

second rope driving means for making the remaining second, third, and fourth slip-off members carry on respective ingoing strokes, synchronous and proportional to the ingoing stroke of the first slip-off member.

3. The telescopic arm as claimed in claim 1, wherein said second idler pulley is fastened to said third slip-off member by means of a second support provided with a second spring tensioner configured to allow the second idler pulley to make small resilient movements in a direction parallel to the longitudinal axis of the above mentioned telescopic arm.

4. The telescopic arm as claimed in claim 1, wherein a "U"-profile channel holder is fastened inside said second slip-off member so as to hold and protect lower branches of said third pipes as a consequence of engagement of said lower branches with said second pulley.

5. The telescopic arm, as claimed in claim 4, wherein said "U"-profile channel holder defines a support for said second pipes, said second pipes being shaped in an initial part, directly downstream of the first pipes, as to be disposed at sides of the channel holder along a whole length of the channel holder.

6. The telescopic arm as claimed in claim 4, wherein said "U"-profile channel holder is supported in place at a rear part of the "U"-profile channel holder, with respect to said second slip-off element, while a fore cantilevered end is provided with wheels configured to roll on lower horizontal walls of the tubular elements that form said third and fourth slip-off members.

7. The telescopic arm as claimed in claim 6, further comprising a ramp, associated to an inner head of said fourth slip-off member, configured to join the level of a lower horizontal wall of the fourth slip-off member to a corresponding wall of said third slip-off member, and provided to be run over by the wheels.

8. A telescopic arm including a tubular outer arm, first, second, third and fourth coaxial slip-off members having a decreasing tubular section, from the biggest to the smallest one, respectively, and an operative head associated at a free end of said fourth slip-off member, said telescopic arm configured to assume a closed configuration, in which said slip-off members are introduced one into another, and housed in said outer arm, and an open configuration, in which the four coaxial slip-off members are at least partially extended to place the operative head in a prefixed working area, the telescopic arm including:

a drive system, supported, at least partially, outside of the tubular outer arm, for synchronously moving the four slip-off members;

a hydraulic circuit, housed inside said tubular outer arm, connected to an outer hydraulic system, for supplying and returning fluid under pressure to and from said operative head, said hydraulic circuit comprising:

first pipes, set in communication with said outer hydraulic system, with ends of said first pipes fastened, respectively upstream and downstream, to said tubular outer arm and to an inner head of said second slip-off member;

a first idler pulley, supported at an inner head of said first slip-off member, in dynamic engagement with said first pipes and configured to keep the first pipes stretched during an ingoing stroke of the first and second slip-off members;

second pipes, connected in series to said first pipes and extended along said second slip-off member up to an outer head of the second slip-off member;

third pipes set in communication with said second pipes and fastened, with respective ends of said third pipes, upstream and downstream, to said second slip-off member and to an inner head of said fourth slip-off member;

a second idler pulley, supported at an inner head of said third slip-off member, in dynamic engagement with said third pipes and configured to keep the third pipes stretched during an ingoing stroke of the third and fourth slip-off members; and fourth pipes, connected in series to said third pipes and extended along said fourth slip-off member up to said operative head wherein a "U"-profile channel holder is fastened inside said second slip-off member so as to hold and protect lower branches of said third pipes as a consequence of engagement of said lower branches with said second pulley, wherein said "U"-profile channel holder is supported in place at a rear part of the "U"-profile channel holder, with respect to said second slip-off element, while a fore cantilevered end is provided with wheels configured to roll on lower horizontal walls of the tubular elements that form said third and fourth slip-off members.

9. The telescopic arm as claimed in claim 8, further comprising a ramp, associated to an inner head of said fourth slip-off member, configured to join the level of a lower horizontal wall of the fourth slip-off member to a corresponding wall of said third slip-off member, and provided to be run over by the wheels.

10. The telescopic arm, as claimed in claim 8, wherein said "U"-profile channel holder defines a support for said second pipes, said second pipes being shaped in an initial part, directly downstream of the first pipes, as to be disposed at sides of the channel holder along a whole length of the channel holder.

* * * * *